US007385341B2

(12) United States Patent
Nishiyama et al.

(10) Patent No.: US 7,385,341 B2
(45) Date of Patent: Jun. 10, 2008

(54) CATHODE-RAY TUBE APPARATUS WITH MAGNETIC SPACERS BETWEEN MAGNETIC RINGS

(75) Inventors: Koji Nishiyama, Ibaraki (JP); Hiroji Morimoto, Kashihara (JP); Akira Satou, Ibaraki (JP); Katsuyo Iwasaki, Nishinomiya (JP); Kenichiro Taniwa, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 606 days.

(21) Appl. No.: 11/069,776

(22) Filed: Mar. 1, 2005

(65) Prior Publication Data

US 2005/0200263 A1 Sep. 15, 2005

(30) Foreign Application Priority Data

Mar. 5, 2004 (JP) ..... 2004-062903

(51) Int. Cl.
*H01J 29/50* (2006.01)

(52) U.S. Cl. ..... 313/412; 313/413; 313/421; 313/431; 313/442

(58) Field of Classification Search ..... 313/412–415, 313/421, 431, 440, 442, 443, 461
See application file for complete search history.

(56) References Cited

U.S. PATENT DOCUMENTS

| | | | | |
|---|---|---|---|---|
| 3,031,405 | A | 4/1962 | Pierrot et al. | 336/233 |
| 3,387,158 | A | 6/1968 | Ohkoshi et al. | 335/212 |
| 4,431,979 | A | 2/1984 | Stijntjes et al. | 335/210 |
| 5,621,287 | A | 4/1997 | Dossot et al. | 315/399 |
| 5,708,323 | A | 1/1998 | Okamoto | 313/431 |
| 6,307,333 | B1 | 10/2001 | Sluyterman et al. | 315/368.28 |
| 6,472,809 | B2 | 10/2002 | Motomiya et al. | 313/440 |
| 7,012,360 | B2 * | 3/2006 | Iwasaki et al. | 313/477 R |
| 2003/0030361 | A1 | 2/2003 | Hirota et al. | 313/440 |
| 2004/0155611 | A1 | 8/2004 | Sakurai et al. | 315/368.15 |
| 2004/0251835 | A1 | 12/2004 | Iwasaki et al. | 315/8 |
| 2005/0057694 | A1 * | 3/2005 | Iwasaki | 348/719 |

FOREIGN PATENT DOCUMENTS

| | | |
|---|---|---|
| EP | 0 484 606 | 5/1992 |
| EP | 0 621 626 | 4/1993 |
| EP | 0 901 147 | 3/1999 |

(Continued)

*Primary Examiner*—Toan Ton
*Assistant Examiner*—Kevin Quarterman
(74) *Attorney, Agent, or Firm*—Hamre, Schumann, Mueller & Larson, P.C.

(57) ABSTRACT

A plurality of magnet rings for correcting a convergence are arranged in a tube axis direction with spacers interposed therebetween, on an outer circumferential surface of a neck. A velocity modulation coil for modulating a scanning velocity in a horizontal direction of an electron beam is placed so that a position of the velocity modulation coil in the tube axis direction is overlapped with those of the magnet rings. At least one of the spacers is made of only a magnetic substance. Alternatively, at least one of the spacers is made of a magnetic substance, and the outermost surface in a radius direction of the spacer made of a magnetic substance is covered with a non-metallic material. Because of this, the magnetic field formed by the velocity modulation coil can be intensified without disturbing the magnetic field of the magnet rings of a CPU.

12 Claims, 7 Drawing Sheets

FOREIGN PATENT DOCUMENTS

| | | |
|---|---|---|
| EP | 1 117 123 | 7/2001 |
| EP | 1 187 168 | 3/2002 |
| EP | 1 460 673 | 9/2004 |
| JP | 57-45650 | 10/1982 |
| JP | 6-283113 | 10/1994 |
| JP | 2003-116019 | 4/2003 |

* cited by examiner

CATHODE-RAY TUBE APPARATUS WITH MAGNETIC SPACERS BETWEEN MAGNETIC RINGS

BACKGROUND OF THE INVENTION

1. Field of the Invention

The present invention relates to a cathode-ray tube apparatus.

2. Description of the Related Art

Recently, in a TV receiver and the like, there is a demand for higher image quality along with the increase in size. As one procedure for this, a cathode-ray tube apparatus has been proposed in which a velocity modulation coil is mounted so as to enhance an edge of an image to sharpen image quality. The velocity modulation coil forms a magnetic field in a vertical scanning direction of an electron beam, and changing a scanning velocity in a horizontal scanning direction of the electron beam, thereby enhancing an edge of an image (e.g., see JP 57(1982)-45650 U).

Furthermore, JP 2003-116019 A describes that a pair of ferromagnets are arranged so as to be opposed to each other on an outer circumferential surface of a neck of a funnel in such a manner as to be respectively paired with a pair of loop coils of a velocity modulation coil. According to this configuration, a magnetic field generated by the velocity modulation coil is intensified by the ferromagnets to act on an electron beam concentratedly, so that a velocity modulation effect can be enhanced.

On the other hand, an ordinary color cathode-ray tube apparatus generally includes a deflection yoke and a convergence and purity unit (CPU). The CPU includes a dipole magnet ring, a quadrupole magnet ring, and a hexapole magnet ring for applying a magnetic field to an electron beam, and is attached to an outer circumferential surface of a neck of a funnel in which an electron gun is contained.

In the case of mounting the velocity modulation coil, the ferromagnets for intensifying and concentrating the magnetic field formed by the velocity modulation coil, and the CPU on an outer circumferential surface of a neck of a funnel, conventionally, the ferromagnets are placed in openings of the loop coils of the velocity modulation coil, respectively, and magnet rings of the CPU are placed so as to cover the ferromagnets. Thus, when seen in a direction orthogonal to a tube axis, the ferromagnets and the magnet rings of the CPU are overlapped with each other. Consequently, the magnetic field generated by the magnet rings of the CPU is influenced by the ferromagnets placed inside of the magnet rings to become non-uniform, and the effect of correcting a convergence by the CPU cannot be obtained sufficiently.

SUMMARY OF THE INVENTION

The present invention solves the above-mentioned problems in the conventional cathode-ray tube apparatuses, and its object is to provide a cathode-ray tube apparatus capable of intensifying the magnetic field of a velocity modulation coil without disturbing the magnetic field of magnet rings of a CPU, thereby displaying an image of satisfactory quality.

A cathode-ray tube apparatus of the present invention includes: a face with a phosphor screen formed on an inner surface; a funnel connected to the face; an electron gun housed in a neck of the funnel; a deflection yoke for deflecting an electron beam emitted from the electron gun in a horizontal direction and a vertical direction, provided on an outer circumferential surface of the funnel; a plurality of magnet rings for correcting a convergence, placed in a tube axis direction on an outer circumferential surface of the neck; at least one spacer placed between the magnet rings placed in the tube axis direction; and a velocity modulation coil for modulating a scanning velocity in the horizontal direction of the electron beam, provided so that a position of the velocity modulation coil in the tube axis direction is overlapped with those of the magnet rings.

In the above configuration, a first cathode-ray tube apparatus is characterized in that at least one of the spacers is made of only a magnetic substance.

In the above configuration, a second cathode-ray tube apparatus is characterized in that at least one of the spacers is made of a magnetic substance, and an outermost surface in a radius direction of the spacer made of a magnetic substance is covered with a non-metallic material.

These and other advantages of the present invention will become apparent to those skilled in the art upon reading and understanding the following detailed description with reference to the accompanying figures.

DESCRIPTION OF THE PREFERRED EMBODIMENTS

Figure 1:
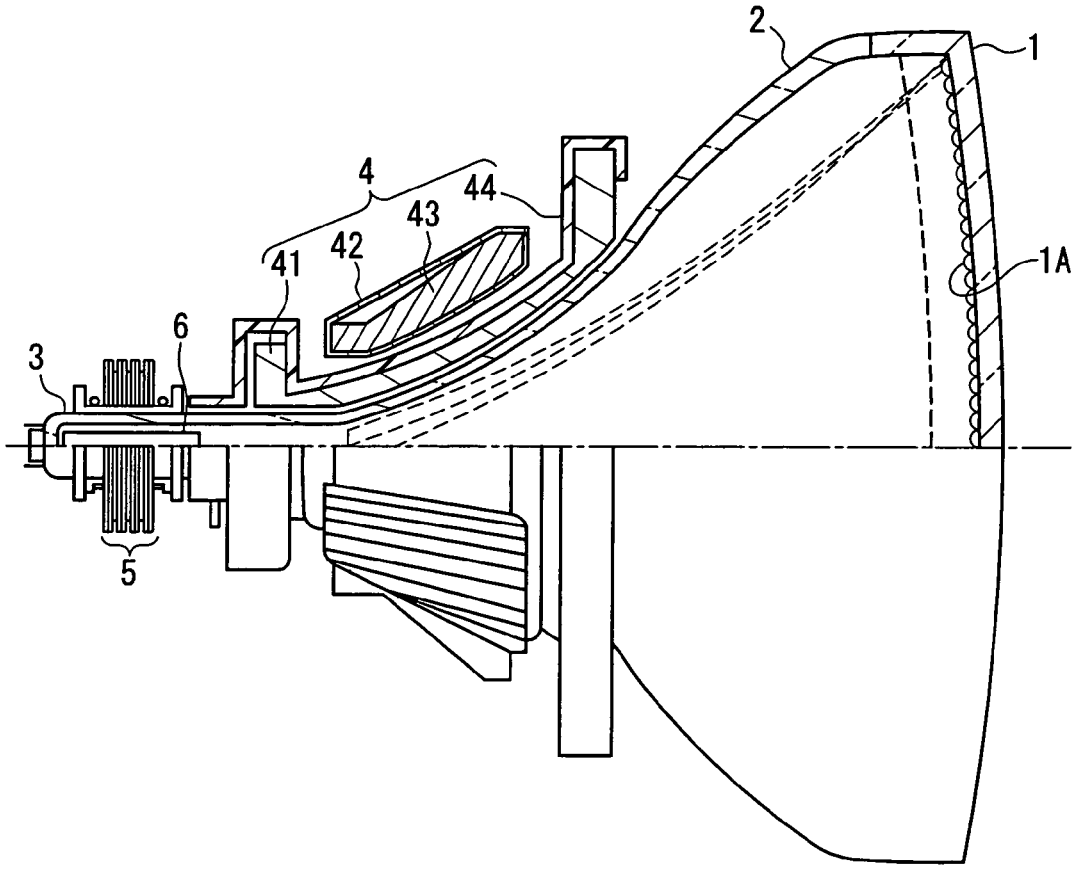
FIG. 1 is a partial cross-sectional view showing a schematic configuration of a cathode-ray tube apparatus according to one embodiment of the present invention.

According to the first and second cathode-ray tube apparatuses of the present invention, the spacer made of a magnetic substance is placed between the magnet rings of the CPU. Therefore, the density of a magnetic flux of the velocity modulation coil can be increased, and the velocity modulation sensitivity can be enhanced without disturbing the magnetic field of the magnet rings of the CPU and without increasing the number of components. Thus, image quality can be enhanced remarkably. Furthermore, the spacer made of a magnetic substance does not influence the operation of correcting a convergence performed by adjusting a rotation phase of the magnet rings, so that a satisfactory convergence can be obtained easily with the magnet rings.

Furthermore, in the first cathode-ray tube apparatus, at least one of the spacers is made of only a magnetic substance, so that the spacers can be produced at a low cost.

Furthermore, in the second cathode-ray tube apparatus, the outermost surface in a radius direction of the spacer made of a magnetic substance is covered with a non-metallic material. Therefore, the spacer can be prevented from being cracked, and even when the spacer is cracked, its shape can be maintained.

In the above-mentioned first and second cathode-ray tube apparatuses of the present invention, it is preferable that the spacer made of a magnetic substance has an annular shape. According to this configuration, the spacer can be mounted without considering the phase around the tube axis, and the effect of enhancing the density of a magnetic flux of the velocity modulation coil can be obtained stably at all times irrespective of the phase around the tube axis.

It is preferable that the magnetic substance is a sintered body of Mg—Zn ferrite. According to this configuration, the density of a magnetic flux can be increased efficiently.

It is preferable that the above-mentioned cathode-ray tube apparatus include at least three sets of magnet rings and a plurality of the spacers made of a magnetic substance. According to this configuration, as the number of spacers made of a magnetic substance is larger, the effect of increasing the density of a magnetic flux of the velocity modulation coil is enhanced, and image quality can be improved.

It is preferable that a position in the tube axis direction of the spacer made of a magnetic substance is matched with a position in the tube axis direction of a gap between two electrodes placed at a distance from each other in the tube axis direction that forms a main lens in the electron gun. According to this configuration, the loss of the magnetic field of the velocity modulation coil can be reduced.

It is preferable that a thickness of the spacer made of a magnetic substance is in a range of 2 mm to 5 mm. When the thickness is less than 2 mm, the effect of increasing the density of a magnetic flux of the velocity modulation coil is decreased. When the thickness exceeds 5 mm, the size of the CPU in the tube axis direction is enlarged undesirably.

Hereinafter, the present invention will be described by way of illustrative embodiments with reference to the drawings.

FIG. 1 is a partial cross-sectional view showing a schematic configuration of a cathode-ray tube apparatus according to one embodiment of the present invention. As shown in FIG. 1, the cathode-ray tube apparatus of the present embodiment includes a cathode-ray tube composed of a face 1 with a phosphor screen 1A formed on an inner surface, a funnel 2 connected to the face 1, and a neck 3 that is a narrowest part of the funnel 2; a deflection yoke 4 for deflecting an electron beam, provided on an outer circumferential surface of a part extending from the funnel 2 to the neck 3; and a CPU 5 for correcting a convergence, provided on a tip end side of the neck 3. An electron gun 6 is provided in the neck 3.

The deflection yoke 4 deflects three electron beams emitted from the electron gun 6 in vertical and horizontal directions, and allows them to scan on the phosphor screen 1A. The deflection yoke 4 includes a horizontal deflection coil 41, a vertical deflection coil 42, and a ferrite core 43. An insulating frame 44 made of resin is provided between the horizontal deflection coil 41 and the vertical deflection coil 42. The insulating frame 44 maintains an electrically insulated state between the horizontal deflection coil 41 and the vertical deflection coil 42, and supports both the deflection coils 41, 42.

Figure 2:
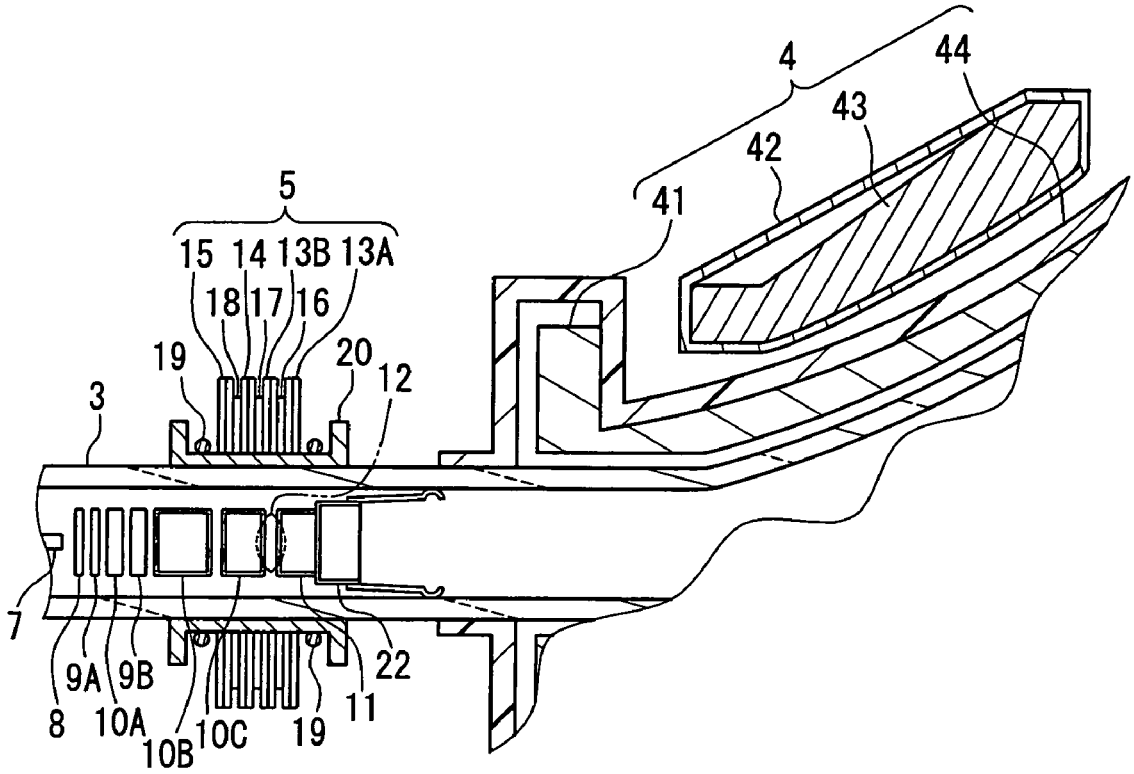
FIG. 2 is an enlarged cross-sectional view of the vicinity of a neck of the cathode-ray tube apparatus according to one embodiment of the present invention.

FIG. 2 is an enlarged cross-sectional view in the vicinity of the neck 3. The electron gun 6 mainly includes three cathodes 7, a control electrode 8, accelerating electrodes 9A, 9B, focusing electrodes 10A, 10B, 10C, and an anode 11. Reference numeral 22 denotes a shield cup connected to the anode 11. When a predetermined voltage is applied to each electrode, a main lens 12 is formed in the vicinity of a region between the focusing electrode 10C and the anode 11, whereby a satisfactory focus is obtained in the phosphor screen 1A.

The CPU 5 includes a dipole magnet ring 13A for adjusting purity, a dipole magnet ring 13B for adjusting a raster distortion, a quadrupole magnet ring 14 and a hexapole magnet ring 15 for adjusting a convergence, and annular spacers 16, 17, 18. The spacers 16, 17, 18 ensure a distance between adjacent magnet rings, and in other words, fill the gap between the adjacent magnet rings. The magnet rings 13A, 13B, 14, 15, and the spacers 16, 17, 18 are provided externally and held on a resin frame 20 in a substantially cylindrical shape fixed to an outer circumferential surface of the neck 3. The magnet rings 13A, 13B, 14, 15 respectively are composed of a pair of magnetic substances in an annular shape. As shown in FIG. 2, the dipole magnet ring 13A for adjusting purity, the dipole magnet ring 13B for adjusting a raster distortion, a quadrupole magnet ring 14 for adjusting a convergence, and a hexapole magnet ring 15 for adjusting a convergence are arranged in this order from the deflection yoke 4 side to the end side of the neck 3. The spacer 16 is placed to fill a region between the dipole magnet rings 13A and 13B so as to be in contact therewith. The spacer 17 is placed to fill a region between the dipole magnet rings 13B and the quadrupole magnet ring 14 so as to be in contact therewith. The spacer 18 is placed to fill a region between the quadrupole magnet ring 14 and the hexapole magnet ring 15 so as to be in contact therewith.

Reference numeral 19 denotes a velocity modulation coil for enhancing an edge of an image. The velocity modulation coil 19 is composed of a pair of loop coils 19A, 19B, and is held on the resin frame 20 so that the pair of loop coils 19A, 19B are opposed to each other in a vertical direction.

Figure 3A:
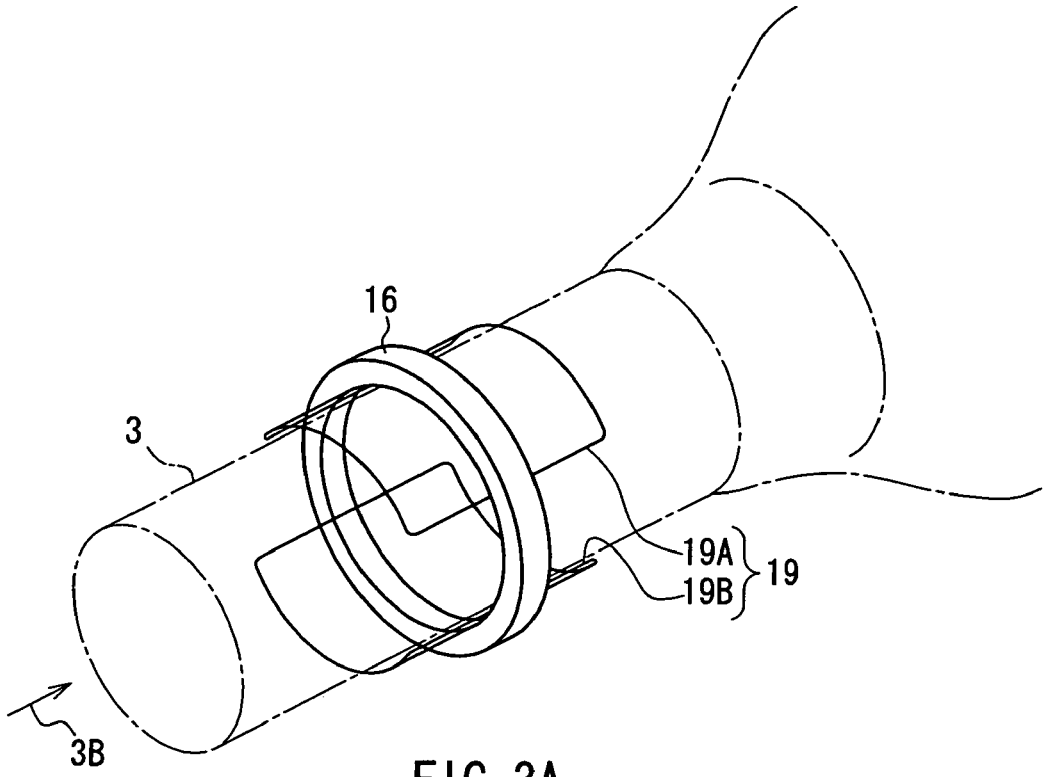
FIG. 3A is a perspective view showing a schematic configuration of a velocity modulation coil.
Figure 3B:
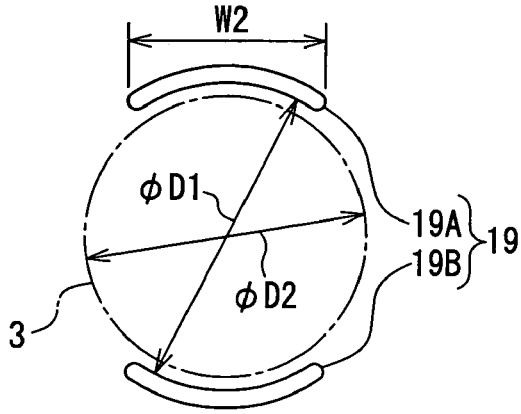
FIG. 3B is a front view of the velocity modulation coil seen in a direction of an arrow 3B along a tube axis shown in FIG. 3A.
Figure 3C:
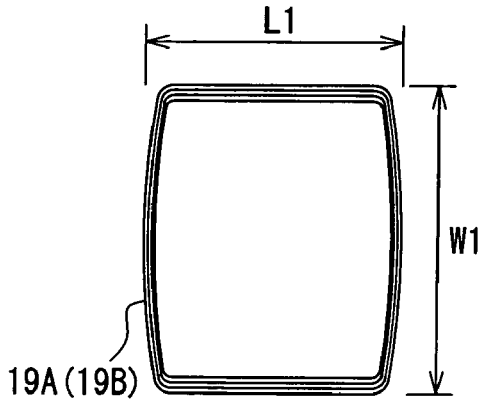
FIG. 3C is a developed plan view of a loop coil constituting the velocity modulation coil.

FIG. 3A is a perspective view showing a schematic configuration of the velocity modulation coil 19. FIG. 3B is a front view of the velocity modulation coil 19 seen in a direction of an arrow 3B along a tube axis shown in FIG. 3A. FIG. 3C is a developed view of the loop coils 19A, 19B constituting the velocity modulation coil 19 developed on a plane.

One example of the velocity modulation coil 19 will be described. The loop coils 19A, 19B have a configuration in which a copper wire coated with polyurethane with a wire diameter of 0.4 mm is wound four turns in a substantially rectangular shape, and as shown in FIG. 3A, they are placed so as to be opposed to each other in a vertical direction under the condition that a pair of opposed sides of each coil are bent along an outer circumferential shape of the neck 3. The size of the substantially rectangular loop coils 19A, 19B when viewed as developed on a plane as shown in FIG. 3C is as follows: a length L1 of respective sides placed substantially parallel to a tube axis direction is 25 mm, and a width W1 between the sides is 35 mm. As shown in FIG. 3B, the sides having the width W1 are deformed to be curved along a virtual cylindrical surface with a diameter D1 of 33 mm, whereby the loop coils 19A, 19B are mounted on the resin frame 20. At this time, a width W2 of the loop coils 19A, 19B in a horizontal direction orthogonal to the tube axis shown in FIG. 3B is 30 mm. D2 denotes the outer diameter of the neck 3, and D1>D2 is satisfied. A current in accordance with a velocity modulation signal obtained by differentiating a video signal is allowed to flow through the velocity modulation coil 19.

As shown in FIG. 2, the velocity modulation coil 19, and the magnet rings 13A, 13B, 14, 15 constituting the CPU 5 are placed so that respective positions in the tube axis direction are overlapped with each other. The dipole magnet ring 13A is placed at substantially the same position as that of the main lens 12 in the tube axis direction so as to suppress the degradation of a focus caused by a purity correction. In order to apply effectively a magnetic field generated from the velocity modulation coil 19 to electron beams, it is preferable to concentrate a magnetic field generated from the velocity modulation coil 19 in a gap between the focusing electrode 10C and the anode 11, forming the main lens 12. Therefore, among the spacers 16, 17, 18, the spacer 16 placed between two sets of the dipole magnet rings 13A, 13B and arranged closest to the dipole magnet ring 13A is made of a magnetic substance. In one example, a sintered body of Mg—Zn ferrite that is a magnetic substance can be used as the spacer 16. The other spacers 17, 18 may be made of resin. The inner diameter of the spacer 16 is 33 mm, which is the same as that of the dipole magnet ring 13A. The outer diameter of the spacer 16 is 44 mm, and the thickness thereof (size in the tube axis direction) is 3 mm.

In order to apply effectively the magnetic field generated from the velocity modulation coil 19 to electron beams, it is preferable that the inner diameter of the spacer 16 made of a magnetic substance is smaller, the outer diameter thereof is larger, and the thickness thereof is larger. In general, the size is determined based on the space constraint in most cases. When the spacer 16 made of a magnetic substance is too thin, the magnetic substance is likely to be cracked, and the velocity modulation sensitivity is degraded. Thus, it is preferable that the thickness of the spacer 16 is equal to or more than 2 mm. When the thickness is too large, the size of the CPU 5 in the tube axis direction becomes undesirably large. Therefore, it is preferable that the thickness generally is 5 mm or less.

Figure 4A:
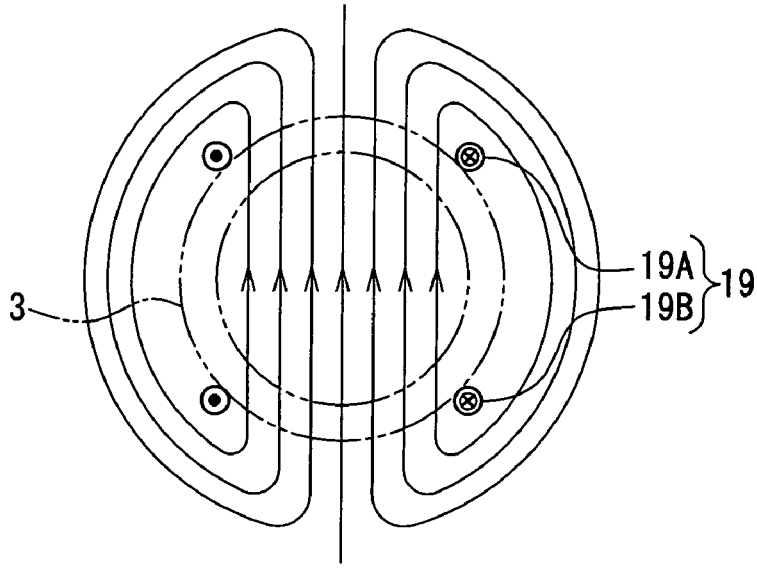
FIG. 4A PRIOR ART
FIG. 4A shows a state of a magnetic flux in the periphery of a velocity modulation coil in a conventional cathode-ray tube apparatus in which all the spacers are made of resin.
Figure 4B:
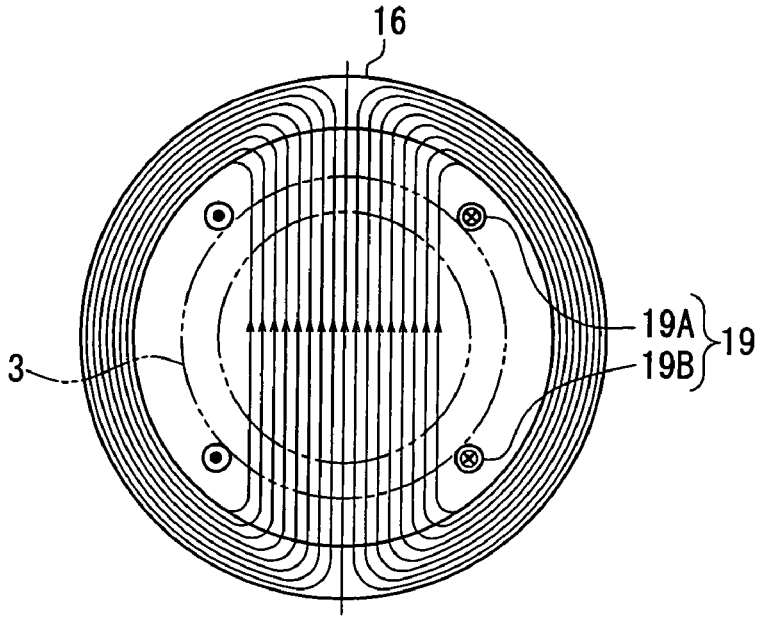
FIG. 4B shows a state of a magnetic flux in the periphery of a velocity modulation coil of the cathode-ray tube apparatus of one embodiment of the present invention.

Owing to the use of the spacer 16 made of a magnetic substance, the density of a magnetic flux acting on electron beams in the neck 3 can be increased. This will be described with reference to the drawings. FIG. 4A shows a state of a magnetic flux in the case where all the spacers are made of resin. FIG. 4B shows a state of a magnetic flux in the case where the spacer 16 made of a magnetic substance is provided. FIGS. 4A and 4B both schematically show a magnetic flux in a plane vertical to the tube axis, which crosses the velocity modulation coil 19. As is understood from FIGS. 4A and 4B, when the spacer 16 made of a magnetic substance is used, a magnetic flux is concentrated in an inside region (electron beam passage region in the neck 3) of the spacer 16 made of a magnetic substance due to a core effect. Therefore, the density of a magnetic flux acting on electron beams is increased. Furthermore, the spacer 16 is provided at substantially the same position as the gap between the focusing electrode 10C and the anode 11 that forms the main lens 12 in the electron gun 6. Therefore, the influence of an eddy current loss in the electrodes can be minimized, and a magnetic field region can be enlarged. Thus, the sensitivity of velocity modulation can be enhanced effectively.

Figure 5A:
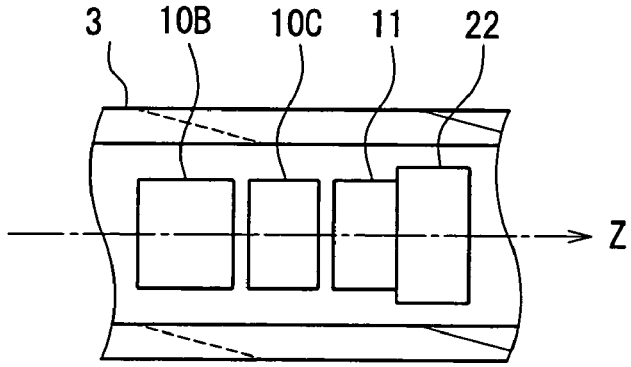
FIG. 5A is a cross-sectional view along a tube axis of a neck.
Figure 5B:
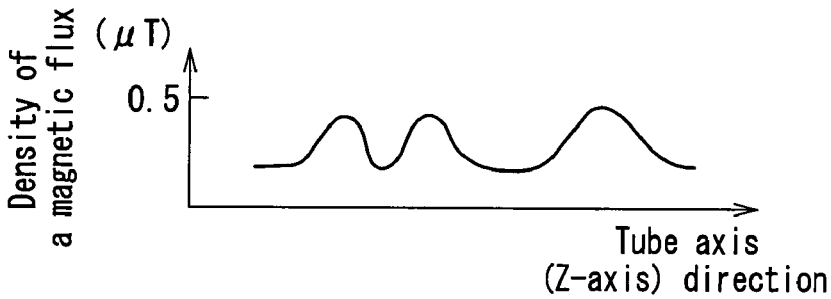
FIG. 5B is a diagram showing results obtained by measuring a change in the density of a magnetic flux along the tube axis (Z-axis) in the case where all the spacers are made of resin.
Figure 5C:
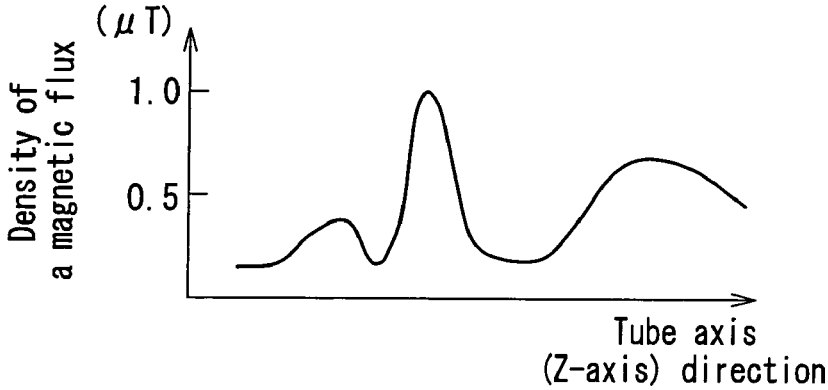
FIG. 5C is a diagram showing results obtained by measuring a change in the density of a magnetic flux along the tube axis (Z-axis) in the case of using a spacer made of a magnetic substance.

A magnetic flux density distribution from the vicinity of the focusing electrode 10B to the vicinity of the shield cup 22 along the tube axis at the center of the neck 3 will be described with reference to FIG. 5. FIG. 5A is a cross-sectional view along the tube axis of the neck 3. FIG. 5B is a diagram showing results obtained by measuring a change in the density of a magnetic flux along the tube axis (Z-axis) in the case where all the spacers are made of resin. FIG. 5C is a diagram showing results obtained by measuring a change in the density of a magnetic flux along the tube axis (Z-axis) in the case of using the spacer 16 made of a magnetic substance. It is understood from FIGS. 5B and 5C that the density of a magnetic flux in the vicinity of the main lens becomes about double owing to the use of the spacer 16 made of a magnetic substance.

Figure 6:
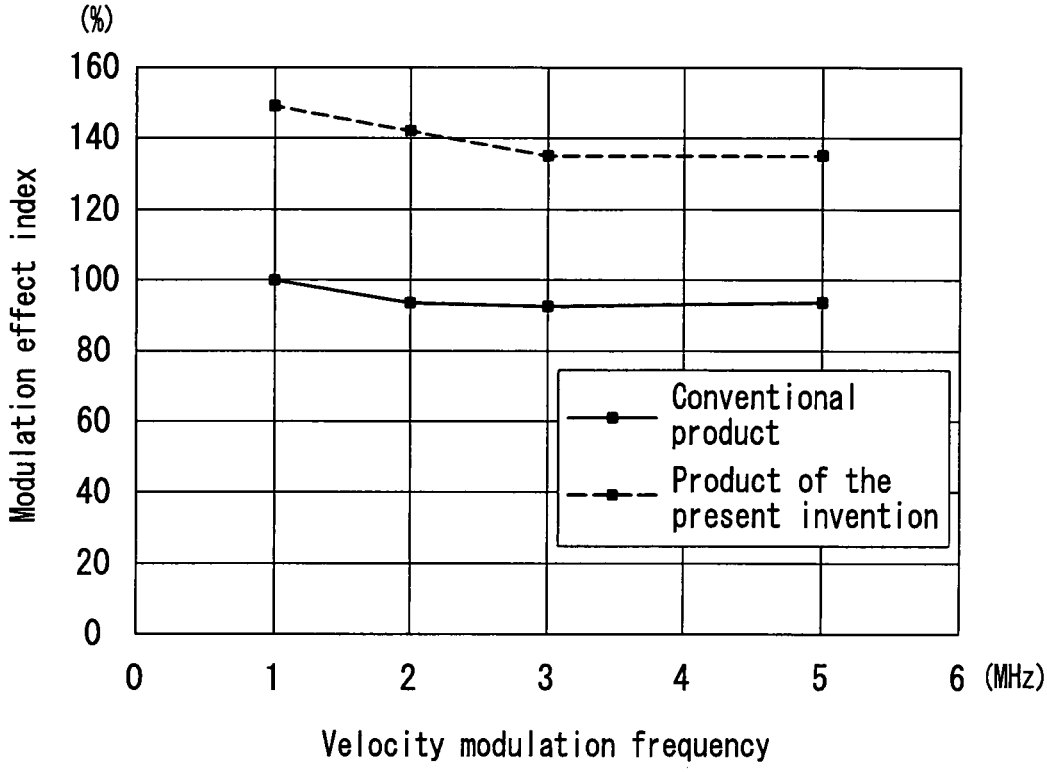
FIG. 6 is a diagram showing results obtained by measuring velocity modulation sensitivity of the cathode-ray tube apparatus of the present invention and the conventional cathode-ray tube apparatus.

Next, experimental results, confirming the effects of the present invention, will be described. The velocity modulation sensitivity was confirmed by actually producing a cathode-ray tube apparatus (product of the present invention) according to the present invention. Furthermore, for comparison, the velocity modulation sensitivity of a cathode-ray tube apparatus (conventional product) that is the same as the product of the present invention except that all the spacers of the CPU 5 are made of resin. FIG. 6 is a graph showing experimental results of the velocity modulation sensitivity. In FIG. 6, a horizontal axis represents a frequency of the velocity modulation signal applied to the velocity modulation coil 19. A modulation effect index represented by a vertical axis shows relatively a displacement amount in a horizontal direction of an electron beam spot having a 5% brightness diameter (spot diameter of an electron beam obtained by removing a part of 5% or less from the lowest brightness, assuming that a brightness peak of an electron beam spot is set to be 100%) at the center portion of the phosphor screen, with the measured value of the conventional product at a velocity modulation frequency of 1 MHz being 100%. As the value of the modulation effect index is higher, the velocity modulation sensitivity is higher, which means that image quality is enhanced. In the experiment, the amount of a current flowing to the velocity modulation coil 19 was set to be constant (i.e., 0.8 A). As shown in FIG. 6, the velocity modulation sensitivity of the product of the present invention was about 1.5 times that of the conventional product, irrespective of the velocity modulation frequency. Actually, the cathode-ray tube apparatus of the present invention and the conventional cathode-ray tube apparatus were respectively incorporated in TV sets, and they were compared in terms of practical image quality. Consequently, the image quality was remarkably enhanced in the TV set using the cathode-ray tube apparatus of the present invention, compared with the TV set using the conventional cathode-ray tube apparatus.

Furthermore, the cathode-ray tube apparatus described in JP 2003-116019 A was produced in which a pair of ferromagnets were arranged so as to be opposed to each other in a vertical direction with electron beams interposed therebetween, on an outer surface of a neck of a cathode-ray tube. Then, the above-mentioned cathode-ray tube apparatus of the present invention was compared with the cathode-ray tube apparatus described in JP 2003-116019 A in terms of the operability of a convergence correction by the CPU. In the cathode-ray tube apparatus described in JP 2003-116019 A, the magnet rings of the CPU were overlapped with the ferromagnets when seen perspectively in a direction orthogonal to the tube axis. Therefore, a magnetic field from the quadrupole and hexapole magnet rings did not become uniform, whereby a convergence was not corrected in some cases. In contrast, in the cathode-ray tube apparatus of the present invention, the magnet rings of the CPU and the spacer 16 made of a magnetic substance were not overlapped with each other when seen perspectively in a direction orthogonal to the tube axis. Therefore, a quadrupole magnetic field and a hexapole magnetic field were distributed uniformly, whereby a convergence was corrected easily. A convergence adjustment time required for one cathode-ray tube apparatus was reduced by about half on average in the cathode-ray tube apparatus of the present invention, compared with the cathode-ray tube apparatus described in JP 2003-116019 A.

Furthermore, in the cathode-ray tube apparatus described in JP 2003-116019 A, it is necessary to further add a pair of ferromagnets to the neck, which increases the number of components and the number of assembly processes, resulting in an increase in cost. In contrast, in the cathode-ray tube apparatus of the present invention, a spacer made of a magnetic substance merely is used in place of the spacer made of resin. Therefore, compared with the cathode-ray tube apparatus described in JP 2003-116019 A, two components corresponding to a pair of ferromagnets can be reduced, which is advantageous in terms of a cost.

In the above embodiment, an example, in which the resin frame 20 holding the CPU 5 and the deflection yoke 4 are separated from each other, has been described. However, the present invention is not limited thereto. The resin frame 20 and the insulating frame 44 of the deflection yoke 4 may be integrated with each other.

Furthermore, in the above-mentioned embodiment, among the three spacers 16, 17, 18 of the CPU 5, only the spacer 16 is made of a magnetic substance. However, the present invention is not limited thereto. The spacers 17 and/or the spacer 18 may be made of a magnetic substance. As the number of spacers made of a magnetic substance increases, the density of a magnetic flux of the velocity modulation coil 19 can be increased further, and the velocity modulation sensitivity is enhanced further. Furthermore, the spacer 16 may be made of resin, and at least one spacer other than the spacer 16 may be made of a magnetic substance.

Furthermore, the use of the spacer made of a magnetic substance can prevent a magnetic field of the deflection yoke 4 from leaking to the electron gun 6 side. Thus, electron beams are not preliminary deflected by a leakage magnetic field from the deflection yoke 4 before passing through the main lens 20, so that the focus in the periphery of the face 1 is rendered more satisfactory.

In the above-mentioned example, as a specific example of a magnetic substance used for the spacer made of a magnetic substance, a sintered body of Mg—Zn ferrite has been illustrated. However, the present invention is not limited thereto. For example, a sintered body of Mn—Zn ferrite, and a sintered body of Ni—Zn ferrite also can be used.

Figure 7:
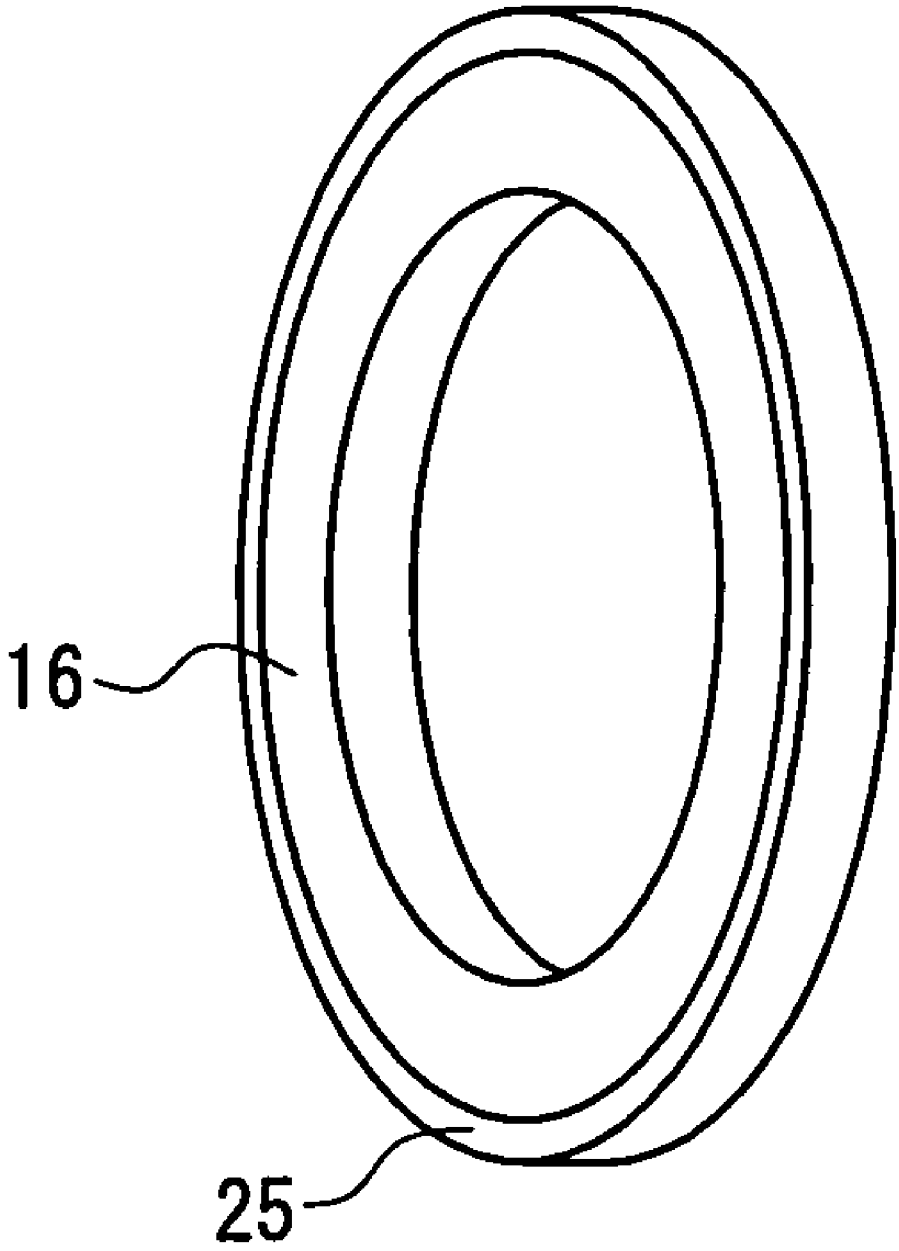
FIG. 7 is a perspective view showing another example of a spacer made of a magnetic substance used in the cathode-ray tube apparatus according to one embodiment of the present invention.

In the above embodiment, an example in which the spacer 16 is made of only a magnetic substance, i.e., an example in which a magnetic substance is exposed on the entire outer surface of the spacer has been shown. However, the present invention is not limited thereto. For example, as shown in FIG. 7, the outside surface of the spacer 16 made of a magnetic substance (surface directed to an opposite side from the tube axis, i.e., outermost surface in a radius direction of the spacer 16), which crosses the surface orthogonal to the tube axis, may be covered with a non-metallic material 25. As a results of this, the spacer 16 is unlikely to be cracked. Furthermore, even if the spacer 16 made of a magnetic substance is cracked after the CPU 5 is mounted on a cathode-ray tube, the entire surface of the magnetic substance is in contact with any of the other members, so that its shape will not be distorted. Thus, the desired effect of enhancing the velocity modulation sensitivity by increasing the density of a magnetic flux can be obtained. Examples of the non-metallic material 25 include a non-metallic tape wound around an outside surface of the spacer 16 to be attached thereto, resin formed, for example, by being integrated with the spacer 16 so as to cover the outside surface of the spacer 16, a flame-retardant adhesive provided so as to cover the outside surface of the spacer 16 after the CPU 5 is mounted on a cathode-ray tube, and the like.

The applicable field of the cathode-ray tube apparatus of the present invention is not particularly limited. For example, the present invention can be used in a wide range as a color picture tube apparatus in a TV, a computer display, and the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode-ray tube apparatus comprising:

a face with a phosphor screen formed on an inner surface;

a funnel connected to the face;

an electron gun housed in a neck of the funnel;

a deflection yoke for deflecting an electron beam emitted from the electron gun in a horizontal direction and a vertical direction, provided on an outer circumferential surface of the funnel;

a plurality of magnet rings for correcting a convergence, placed in a tube axis direction on an outer circumferential surface of the neck;

at least one spacer placed between the magnet rings placed in the tube axis direction; and a velocity modulation coil for modulating a scanning velocity in the horizontal direction of the electron beam, provided so that a position of the velocity modulation coil in the tube axis direction is overlapped with those of the magnet rings, wherein at least one of the spacers is made of only a magnetic substance.

2. The cathode-ray tube apparatus according to claim 1, wherein the spacer made of a magnetic substance has an annular shape.

3. The cathode-ray tube apparatus according to claim 1, wherein the magnetic substance of said at least one of the spacers is a sintered body of Mg—Zn ferrite.

4. The cathode-ray tube apparatus according to claim 1, comprising at least three sets of the magnet rings and a plurality of the spacers made of a magnetic substance.

5. The cathode-ray tube apparatus according to claim 1, wherein a position in the tube axis direction of the spacer made of a magnetic substance is matched with a position in the tube axis direction of a gap between two electrodes placed at a distance from each other in the tube axis direction that forms a main lens in the electron gun.

6. The cathode-ray tube apparatus according to claim 1, wherein a thickness of the spacer made of a magnetic substance is in a range of 2 mm to 5 mm.

7. A cathode-ray tube apparatus comprising:

a face with a phosphor screen formed on an inner surface;

a funnel connected to the face;

an electron gun housed in a neck of the funnel;

a deflection yoke for deflecting an electron beam emitted from the electron gun in a horizontal direction and a vertical direction, provided on an outer circumferential surface of the funnel;

a plurality of magnet rings for correcting a convergence, placed in a tube axis direction on an outer circumferential surface of the neck;

at least one spacer placed between the magnet rings placed in the tube axis direction; and a velocity modulation coil for modulating a scanning velocity in the horizontal direction of the electron beam, provided so that a position of the velocity modulation coil in the tube axis direction is overlapped with those of the magnet rings, wherein at least one of the spacers is made of a magnetic substance, and an outermost surface in a radius direction of the spacer made of a magnetic substance is covered with a non-metallic material.

8. The cathode-ray tube apparatus according to claim 7, wherein the spacer made of a magnetic substance has an annular shape.

9. The cathode-ray tube apparatus according to claim 7, wherein the magnetic substance of said at least one of the spacers is a sintered body of Mg—Zn ferrite.

10. The cathode-ray tube apparatus according to claim 7, comprising at least three sets of the magnet rings and a plurality of the spacers made of a magnetic substance.

11. The cathode-ray tube apparatus according to claim 7, wherein a position in the tube axis direction of the spacer made of a magnetic substance is matched with a position in the tube axis direction of a gap between two electrodes placed at a distance from each other in the tube axis direction that forms a main lens in the electron gun.

12. The cathode-ray tube apparatus according to claim 7, wherein a thickness of the spacer made of a magnetic substance is in a range of 2 mm to 5 mm.

* * * * *